United States Patent [19]

Thomson et al.

[11] Patent Number: 4,754,532

[45] Date of Patent: Jul. 5, 1988

[54] ADJUSTABLE QUICK RELEASE MAGNETIC HOLDING ASSEMBLY

[76] Inventors: Richard E. Thomson, 11359 West Saanich Road, Sidney, British Columbia, Canada, V8L 3X9; Peter G. Berrang, 515 Linden Avenue, Victoria, British Columbia, Canada, V8V 4G6

[21] Appl. No.: 17,919

[22] Filed: Feb. 24, 1987

[51] Int. Cl.[4] ..... E05C 19/16

[52] U.S. Cl. ..... 24/303; 292/251.5; 335/285

[58] Field of Search ..... 24/303, 94, 49 M, 688, 24/150 R; 292/251.5; 335/236, 285; 248/206.5

[56] References Cited

U.S. PATENT DOCUMENTS

| | | | |
|---|---|---|---|
| 2,812,203 | 11/1957 | Scholten | 292/251.5 |
| 3,009,225 | 11/1961 | Budreck | 24/303 |
| 3,086,268 | 4/1963 | Chaffin, Jr. | 335/285 |
| 3,641,693 | 2/1972 | Pinnow | 24/303 |
| 4,031,652 | 6/1977 | Johnson | 24/303 |
| 4,422,137 | 12/1983 | Watts | 248/206.5 |
| 4,455,719 | 6/1984 | Morita | 24/303 |
| 4,536,732 | 8/1985 | Schindl et al. | 24/303 |

FOREIGN PATENT DOCUMENTS

| | | | |
|---|---|---|---|
| 0960115 | 6/1964 | United Kingdom | 24/303 |

*Primary Examiner*—Victor N. Sakran

*Attorney, Agent, or Firm*—Fetherstonhaugh & Co.

[57] ABSTRACT

A variable strength magnetic holding assembly as disclosed. It includes an attachment plate with a section made of magnetic material and a holding and support assembly adapted to magnetically hold the attachment plate thereon. An adjustment knob is used to vary the magnetic coupling between the attachment plate and the holding and support assembly.

18 Claims, 4 Drawing Sheets

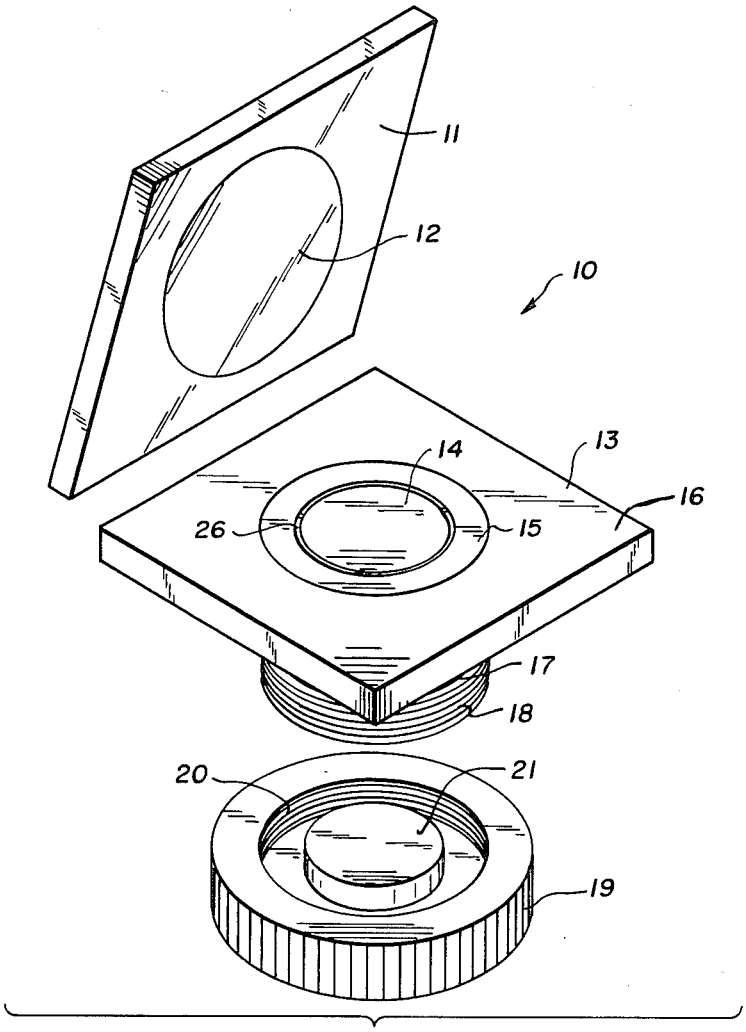
Fig. 1.
Fig. 2.
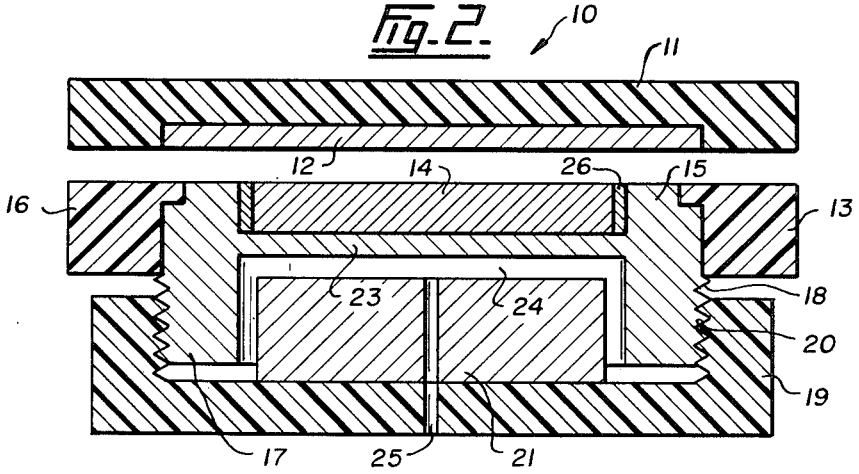

ADJUSTABLE QUICK RELEASE MAGNETIC HOLDING ASSEMBLY

FIELD OF THE INVENTION

This invention relates to magnetic holding assemblies but more particularly to an adjustable strength, magnetic holding assembly which takes advantage of the marked dichotomy between the comparatively strong normal component and the comparatively weak sheer component of the magnetic locking force. Specific applications include windsurfer/board sailing harnesses, ski bindings, trapeze harnesses and other weight support systems requiring a variable strength locking mechanism combined with a quick release capability.

BACKGROUND OF THE INVENTION

Magnetic latches are used in a variety of applications ranging from industrial electromagnetic coupling devices to cupboard and refrigerator latches. These invariably make use of the comparatively strong holding force in the direction of the magnetic flux lines. None of these devices incorporate a combined adjustable and safety release magnetic locking mechanism.

The present invention arose from the need for a quick release mechanism for windsurfer/sailing board body support harnesses. All available body harnesses make use of a hook affixed to a spreader bar. To use the harness, the board sailer hooks on to a looped line hanging from the wishbone of the windsurfer board. The pull of the sail is then transferred to the torso of the sailor who leans backward to achieve a lever arm balance between the vertical lift of the sail and the downward pull of gravity. To free himself from the looped line (and hence the wishbone and sail), the board sailor must pull forward on the wishbone with his arms. This releases the tension on the line and allows it to fall free of the hook attached to the spreader bar. Problems arise when the board sailor accidentally hooks onto the line or is pulled suddenly to leeward by a gust of wind, a wave induced lurch of the board or some other abrupt motion. The board sailor is unable to unhook by releasing the line tension and frequently becomes entangled in the line as he topples into the water.

SUMMARY OF THE INVENTION

This embarrassing and sometimes potentially dangerous situation can be avoided using the quick release magnetic holding assembly disclosed in the present invention. In addition, the holding assembly provides a convenient mechanism for detachment while sailing under controlled conditions with full tension on the support harness. To disengage, the board sailor dips his body slightly causing the wishbone attachment line to jerk upward on the harness hook which is attached via a magnetic holding plate to the spreader bar. The hook plate assembly then slides past the magnet fixed to the spreader bar, pivots under tension from the loop line and subsequently releases the line. The line falls free and the board sailor is detached from the wishbone and sail. An elastic cord quickly returns the hook plate assembly to the magnetic assembly attached to the spreader bar and the board sailor is ready to be reattached to the wishbone line.

Adjustment of the locking intensity can be affected by the controlled in-out movement of a magnet or magnetic material which alters the magnetic flux of a predesigned magnetic circuit within the assembly. And hence, magnetic flux within the locking portion of the circuit leads to intensification of the in-line holding force between the magnetic assembly and an external holding or locking plate; the decreased magnetic flux leads to the opposite response.

The quick release capability of the latch is based on the low resistance of magnetically coupled materials to shearing motions normal to the lines of magnetic flux. Whereas considerable force is required to separate the magnetically coupled materials in the direction of magnetic flux, a much lower frictional force must be overcome in order to slide the materials apart in a direction normal to the flux lines. The frictional force is proportional to the in-line magnetic force and to the coefficient of friction, where the coefficient of static friction is more than the coefficient of sliding friction. A slight body motion is required to initiate the quick release sheer mode and, once initiated, the release continues relatively unimpeded. The elastic return mechanism is incorporated into the design in order to bring the attachment plate to its starting (normal) configuration.

Accordingly, a first aspect of the present invention is to provide a magnet holding assembly, comprising: an attachment plate with a section thereof made of magnetic material; a holding and support assembly adapted to magnetically hold said attachment plate thereon, said assembly having an element made of magnetic material and a permanent magnet positioned near said element, magnetically coupled with said element and said attachment plate section, wherein said section, element and permanent magnet form a magnetic circuit; means for adjusting the magnetic coupling between said permanent magnet, element and said section of said attachment plate made of magnetic material, by varying the separation between the permanent magnet and at least one of said magnetically coupled materials in the direction of the magnetic flux, such that the magnetic holding force between said attachment plate and said magnetic holding and support assembly can be adjusted.

A second aspect of the present invention is to provide a magnetic holding assembly for use with a windsurfer harness having a hook adapted to be secured to a spreader bar, comprising an attachment plate with a section thereof made of magnetic material and wherein said hook is secured thereto; a magnetic holding and support assembly forming part of said spreader bar and adapted to magnetically hold said attachment plate thereon.

DRAWINGS

Particular embodiments will be understood in conjunction with the accompanied drawings in which:

FIG. 1 is an exploded view of the magnetic holding assembly;

FIG. 2 is a sectional view of the magnetic holding assembly according to preferred embodiment of the present invention;

DESCRIPTION OF THE PREFERRED EMBODIMENT

Figure 9:
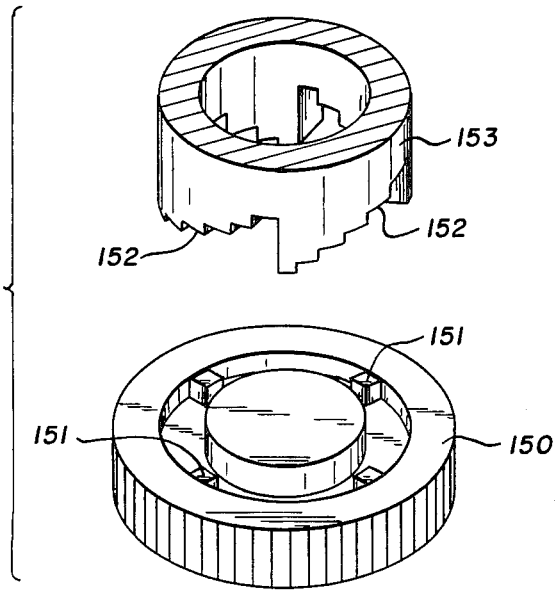
FIG. 9 is the partially sectioned exploded view of another embodiment of the adjustment knob used with the magnetic holding assembly.

FIG. 1 gives a general overview of the basic components that form part of the magnetic holding assembly of the present invention. As depicted by referenced numeral 10, the variable strength magnetic holding assembly is comprised of three main components. These include an attachment plate 11 having a disk like section 12 centrally positioned therein and made of a magnetic material. A magnetic holding and support assembly 13 is adapted to magnetically hold the attachment plate 11 thereon. This assembly 13 is comprised of permanent magnet 14 surrounded by a non-magnetic ring-shaped bonding material 26 and a ring-shaped mount 15 positioned within a non-magnetic holding plate 16. The bonding material 26 also act as a spacer to prevent sideway flux leakage between magnet 14 and mount 15. Ring-shaped mount 15 extends below mounting plate 16 to form tubular element 17. Tubular elements 17 can be provided with a series of threads 18 adapted to permit the securing of an adjustment knob 19. Knob 19 has a series of threads 20 and a disk-like section 21 having an exterior diameter smaller in cross-sectional area than the interior diameter of tubular element 17. The use of cams to replace the threads has been found to be preferable. Such a cam design is shown in FIG. 9. The ring shaped mount 15 and disk like element 21 of adjustment knob 19 are also made of magnetic material. The particular construction of the magnetic holding assembly will, of course, vary according to the specific type of embodiment used. The structure shown in FIG. 1 discloses the preferred embodiment of the present invention.

The elements made of magnetic material form with permanent magnet 14 a magnetic circuit. The variation of the separation between the permanent magnet 14 and at least one of the elements made of magnetic material, in the direction of the magnetic flux lines, will be such that the magnetic holding force between the attachment plate element 12 and the magnetic holding and support assembly can be adjusted.

Referring now to FIG. 2 we have shown a sectional view of the magnetic holding assembly according to the preferred embodiment of the present invention. Attachment plate 11 is made of a non-magnetic material such as plastic or aluminum. The disk like element 12 is made of relatively thin magnetic material which forms with the attachment plate a relatively flat surface adapted to be magnetically held onto the magnetic holding and support assembly 13.

The magnetic holding and support assembly 13 comprises a permanent magnet 14 which is secured by means of non-magnetic bounding material 26 within a circular two chamber ring 15 made of magnetic material. The upper surface of the magnet 14 and encompassing ring 15 present a flat surface for attachment to disk 12 and attachment plate 11. The lower surface of the magnet can be supported by a bridge 23 that separates the two chambers of the ring. The lower section of ring mount 15 extends downwardly from support plate 16 to form a tubular element 17 having threads 18 which will mate with threads 20 of adjustment knob 19 as indicated before, threads 18 and 20 can be replaced by a cam adjusting system. Adjustment knob 19 can be made of non-magnetic material such as plastic or wood. Knob 19 is provided with a disk like element 21 made of magnetic material and having a diameter slightly smaller than the inside diameter of the lower chamber of ring 15.

Permanent magnet 14 along with element 12, 21 and ring 15 are made of magnetic material and form a magnetic circuit. The central axes of magnet 14 and disk like element 21 are aligned such that when adjustment knob 19 is rotated, disk-like element 21 is free to move along the axial direction of permanent magnet 14 and ring 15 of the magnetic holding and support assembly 13.

The adjustment of the locking intensity is affected by the controlled movement of element 21 which alters the magnetic flux of the magnetic circuit present in the assembly. The tightening of adjustment knob 19 and hence the reduction of the air gap between magnet 14 and element 21 results in an enhanced magnetic flux within the locking portion of the circuit and, therefore, leads to intensification of the in-line holding force between attachment plate 11 and holding assembly 13.

On the other hand, when adjustment knob 19 is untightened, air gap 24 is increased thereby decreasing the magnetic flux lines and accordingly leading to a decrease of the holding force between locking plate 11 and holding assembly 13. A vent hole 25 is used to permit the release of trapped air or water which may be present between adjustment knob 19 and magnetic holding and support assembly 13.

Figure 3:
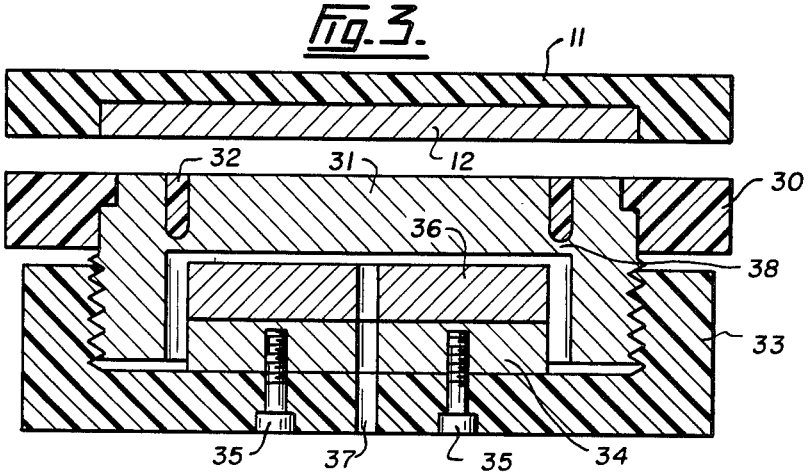
FIG. 3 is a sectional view of the magnetic holding assembly according to a second embodiment of the present invention.
Figure 4:
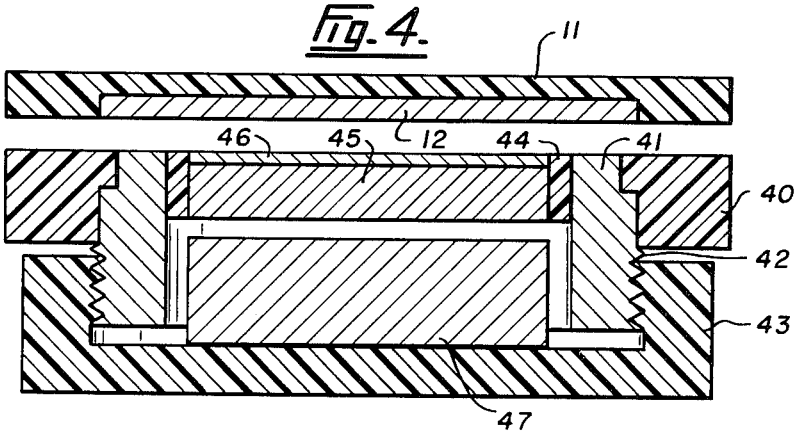
FIG. 4 is a sectional view of the magnetic holding assembly according to a third embodiment of the present invention.

Referring now to FIG. 3, we have shown a sectional view of a magnetic holding assembly according a second embodiment of the present invention. The locking plate 11 remains unchanged, however, the magnetic holding and support assembly 30 no longer retains the permanent magnet. This assembly now includes a cylindrical shaped mount 31 made of magnetic material which except for a ring shaped spacer 32, is integrally complete. Gap 38 between spacer 32 and the lower chamber of mount 31 is very small. This gap can however be filled by spacer 32 as shown in FIG. 4 with spacer 44. In this embodiment, adjustment knob 33 includes an element made of magnetic material 34 secured to adjustment knob 33 by means of a set of non-magnetic screws 35. A permanent magnet 36 is mounted onto element 34 and secured thereto by means of a non-magnetic bonding material. The rotation of adjustment knob 33 will effect the magnetic coupling between permanent magnet 36 and elements 12, 31 and 34 which are all made of magnetic material. The variation in the magnetic coupling will therefore effect the magnetic holding force between locking plate 11 and magnetic holding and support assembly 30. Adjustment knob 33 is also provided with a vent 37 to permit the escape of water or air present between adjustment knob 33 and element 31.

Referring now to FIG. 4, we have shown a sectional view of a third embodiment of the magnetic holding assembly according to the present invention. Similarly, in this embodiment attachment plate 11 and disk like element 12 remain unchanged. The magnetic holding and support assembly 40 is comprised of a ring shaped mount 41 made of magnetic material and having a series of threads 42 to permit adjustment knob 43 to be threaded thereon. A non-magnetic ring shaped spacer 44 surrounds the permanent magnet 45 and is located within ring shaped mount 41. A thin disk like element 46 can be located inside the ring shaped spacer 44 and positioned on permanent magnet 45. A disk like element 47 made of magnetic material is secured on adjustment knob 43 by means of bonding material or non-magnetic screws.

Figure 5:
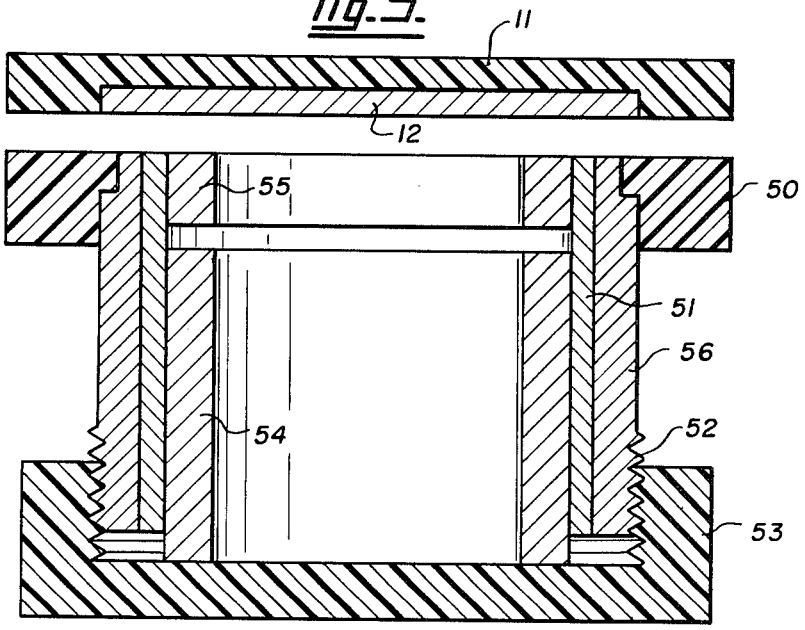
FIG. 5 is a sectional view of the magnetic holding assembly according to a fourth embodiment of the present invention.

Referring now to FIG. 5 we have shown a sectional view of a fourth embodiment of the magnetic holding assembly according to the present invention. The attachment plate remains unchanged as shown at reference numeral 11, however, the magnetic holding assembly 50 now inlcudes a cylinder shaped permanent magnet 51 as well as a cylinder shaped element made of magnetic material 56. Element 56 has threads 52 adpated to permit mounting of adjustment knob 53 which has a cylindrical element 54 made of magnetic material and which is adapted to fit within cylindrical magnet 51. A ring made of magnetic material 55 is positioned at the surface, within cylindrical magnet 51 and help complete the magnetic circuit of the assembly.

As is apparent from each of the above described embodiments, the permanent magnet and at least one of the elements of magnetic material are aligned with respect to each other along the same central axes such that the rotation of the adjustment knob controls the relative movement of either permanent magnet or a segment of magnetic material within the holding assembly and thus permit a variation of the magnetic holding force between the attachment plate and the magnetic holding assembly.

Figure 6:
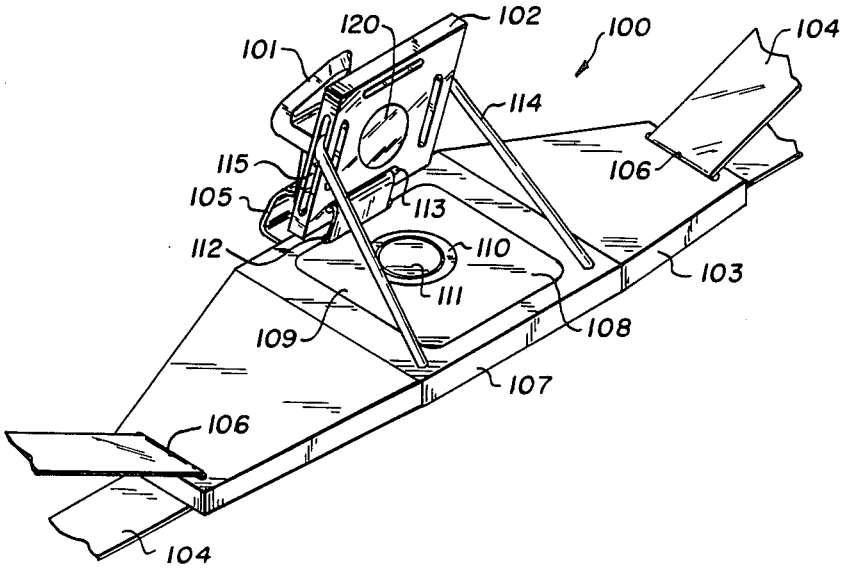
FIGS. 6 and 7 are prospective views of the magnetic holding assembly as applied to board sailor spreader bar.
Figure 7:
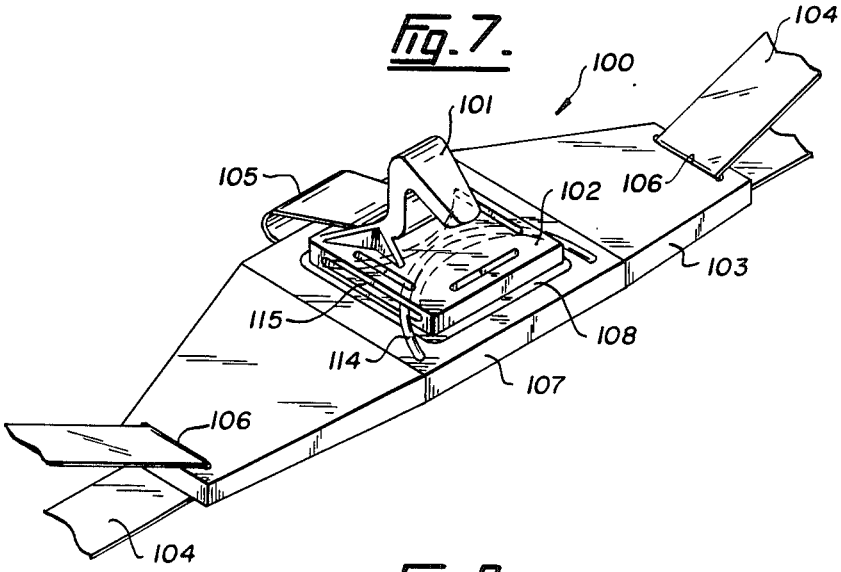

Referring now to FIGS. 6 and 7, we have shown perspective views of the magnetic holding assembly of the present invention as can be used on a windsurfer harness gear. The standard type of harness consists of some form of hook permanently attached to a "spreader bar". This spreader bar helps distribute the load along the board sailor's torso and is usually constructed of metal, wood or plastic depending on the brand. With this sort of arrangement, the rider's body will tend to be positioned perpendicular to a support line connecting the hook to the "wishbone" of the windsurfer.

An improved windsurfer harness using the magnetic holding and support assembly of the present invention is shown generally at reference numeral 100 in FIGS. 6 and 7. In this embodiment, the hook 101 which is adapted to be connected by means of a support line to the wishbone of the windsurfer, is secured or permanently attached to the attachement plate 102 which forms part of the magnetic holding and support assembly. The spreader bar which helps distribute the load is shown at reference numeral 103 and can be worn by the board sailor by means of a pair of straps 104. Each strap 104 is fed through an opening 106 located at the edge of the spreader bar 103. The central section 107 of spreader bar 103 is adapted to receive the magnetic holding and support assembly 108 which includes a mounting plate 109 made of non-magnetic material such as plastic or aluminum, a ring-shaped mount 110 made of magnetic material and a permanent magnet 111 centrally located therein. Attachment plate 102 is provided with a central section 120 made of magnetic material.

The attachment plate 102 is pivotably and slideably mounted onto central section 107 of spreader bar 103 by means of looped strap 105 which is fed through side opening 112 of central section 107 and side opening 113 of attachment plate 102. This securing arrangment will permit attachment plate 102 to slide or pivot with respect to magnetic holding and support assembly 108 according to the type of force being exerted onto hook 101. A line 114 having elastomeric properties is led from one side of section 107 through a cavity 115 within attachment plate 102 to the opposite side of section 107, as shown by the phantom lines, cavity 115 has rounded edges. This cavity will permit line 114 to slide towards the pivot point as plate 102 pivots and will facilitate the unhooking of the support line which is attached to the wishbone of the windsurfer. Line 114 is shown in FIG. 6 in its stretched condition and in FIG. 7 in its unstretched condition. The line can consist of simple bungie cord.

Figure 8:
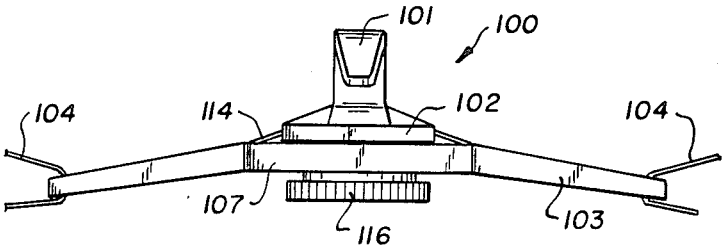
FIG. 8 is a front view thereof.

Referring now to FIG. 8 we have shown a front view of the harness arrangement shown in FIG. 6 and 7. This view shows the location of adjustment knob 116 and also the path taken by strap 104 through spreader bar 103.

In operation, the board sailor's spreader bar would be used as a regular windsurfer spreader bar, i.e. with his body generally perpendicular to the support line connecting hook 101 to the wishbone of the windsurfer. In this position, attachment plate 102 would remain in position since magnetic coupling is strongest in the direction normal to the plane of attachment plate 102 and holding and support assembly 108. Accordingly, considerable force would be required to separate the magnetically coupled materials in the direction of magnetic flux, whereas much lower frictional force must be overcome in order to slide attachment plate 102 over holding and support plate 108. This movement being in the direction normal to the flux line. Accordingly, to uncouple, the rider simply causes the hook to slide perpendicularly to the direct line-of-pull (i.e. parallel to the direction normal to the magnetic force). The rider achieves this by slightly lowering his body position (squatting) relative to the wishbone thereby initiating the quick release sheer mode, and once initiated, the release continues relatively unimpeded. Once element 120 of attachment plate 102 has slid past permanent magnetic 111, the magnetic holding force will be unable to retain attachment plate 102. Tension on the line connected to hook 101 will be such as to create a pivoting action of attachment plate 102 about a portion of strap 105 at opening 112 of central section 107. Retaining line 114 will therefore stretch until the support line becomes unhooked. Line 114 will contract and thus allow the attachment plate 102 to return to its normal working position as shown in FIG. 7. Note that the present assembly can readily be configured to a standard non-release mode by affixing the plate 102 to section 107 using a loop of Velcro, a pin or other form of clamp.

FIG. 9 shows a partially sectioned exploded view of another embodiment of the adjustment knob used with the magnetic holding and support assembly. Adjustment knob 150 includes a series of raised prongs 151 which are adapted to ride over a corresponding number of notched inclined planes 152 and would in effect replace the treaded arrangment 18 of cylindrical extension 17 showed FIGS. 1 and 2, as well as the threads of ring-shaped mount 31 and 41 shown FIGS. 3 and 4 respectively. The magnetic coupling between adjustment knob 150 and cylindrical extention 153 is so strong as to prevent accidental separation of these parts.

As will be apparent to those skilled in the art in the light of the foregoing disclosure, many alterations and modifications are possible in the practice of this invention without departing from the spirit or scope thereof.

Accordingly, the scope of the invention is to be construed in accordance with the substance defined by the following claims.

We claim:

1. A variable strength magnetic holding assembly, comprising:

an attachment plate with a section thereof made of magnetic material;

a holding and support assembly adapted to magnetically hold said attachment plate thereon, said assembly having an element made of magnetic material separated by a non-magnetic spacer from a permanent magnet positioned near said element, said magnet being magnetically coupled with said element and said attachment plate section, wherein said section, element, non-magnetic spacer and permanent magnet form a magnetic circuit;

means for adjusting the magnetic coupling between said permanent magnet, element and said section of said attachment plate made of magnetic material, by varying the separation between the permanent magnet and at least one of said magnetically coupled materials in the direction of the magnetic flux, such that the magnetic holding force between said attachment plate and said magnetic holding and support assembly can be adjusted.

2. A variable strength magnetic holding assembly as defined in claim 1 wherein said element consists of a ring-shaped mount.

3. A variable strength magnetic holding assembly as defined in claim 2 wherein said adjusting means comprises a rotatable mount having a section thereof made of magnetic material which forms part of said magnetic circuit, said rotatable mount being secured to said ring mount of said magnetic holding and support assembly such that rotation of said mount will vary the separation and magnetic coupling between said magnet and said magnetically coupled material.

4. A variable strength magnetic holding assembly as defined in claim 3 wherein said permanent magnet is positioned on said rotatable mount between said ring mount and the section of said rotatable mount made of magnetic material.

5. A variable strength magnetic holding assembly as defined in claim 3 wherein said permanent magnet is mounted on said ring mount between sections of magnetic material of said attachment plate and said rotatable mount.

6. A variable strength magnetic holding assembly as defined in claim 2 wherein said varying means comprises a rotatable mount having a cylindrical section thereof made of magnetic material which forms part of said magnetic circuit, said adjusting means being rotatably mounted to a cylindrical ring of magnetic material and a cylindrical permanent magnet, with magnetic flux lines directed radially, positioned around said ring mount and said cylindrical section such that rotation of said rotatable section will vary the separation between segments of the cylindrical section and therefore the magnetic coupling between said magnet and the cylindrical section of said rotatable mount made of magnetic material.

7. A variable strength magnetic holding assembly as defined in claim 4 wherein said rotatable mount can be separated from said ring mount by means of threads between said rotatable mount and said ring mount.

8. A variable strength magnetic holding assembly as defined in claim 5 wherein the separation between said rotatable mount and said ring mount can be adjusted by means of threads positioned thereon.

9. A variable strength magnetic holding assembly as defined in claim 4 wherein the separation between said ring mount and said rotatable mount can be adjusted by means of one or more cams.

10. A variable strength magnetic holding assembly as defined in claim 5 wherein separation between said ring mount and said rotatable mount can be adjusted by means of one or more cams.

11. A variable strength magnetic holding assembly as defined in claim 6 wherein separation between said fixed inner ring mount and said rotatable mount can be adjusted by means of threads located thereon.

12. A variable strength magnetic holding assembly as defined in claim 6 wherein the separation between said rotatable and said fixed inner ring mount can be adjusted by means of one or more cams located thereon.

13. A variable strength magnetic holding assembly as defined in claim 4 wherein said rotatable mount is comprised of an adjustment knob made of nonmagnetic material to which is bonded a disk shaped section of magnetic material to which is secured said permanent magnet.

14. A variable strength magnetic holding assembly as defined in claim 5 wherein said permanent magnet is fixed concentrically within a circular chamber of said ring mount, said magnet having a flat upper surface for the magnetic attachment of said attachment plate.

15. A variable strength magnetic holding assembly as defined in claim 1 wherein said attachment plate is connected to an open hook and said magnetic holding and support assembly forms part of a windsurfer spreader bar, said attachment plate being slideably and pivotably mounted to said holding and support assembly by connecting means.

16. A variable strength magnetic holding assembly as defined in claim 14 wherein said connecting means comprised a strap forming a loop around openings on an edge of said locking attachment and said spreader bar.

17. A variable strength magnetic holding assembly as defined in claim 15 further comprises elastomeric connecting means for connecting said attachment plate and said spreader bar.

18. A magnetic holding assembly for use with a windsurfer harness having a hook adapted to be secured to a spreader bar, comprising:

an attachment plate with a section thereof made of magnetic material and wherein said hook is secured thereto;

a magnetic holding and support assembly forming part of said spreader bar and adapted to magnetically hold said attachment plate thereon, said magnetic holding and support assembly being comprised of an element made of magnetic material and a permanent magnet positioned near said element, magentically coupled to said element and said attachment plate section wherein said section, element and permanent magnet form a magnetic circuit; and means for adjusting the magnetic coupling between said permanent magnet, element and said section of said attachment plate made of magnetic material, by varying the separation between the permanent magent and at least one of said magnetically coupled materials in the direction of the magnetic flux, such that the magentic holding force between said attachment plate and said assembly can be adjusted.

* * * * *